US010741938B2

(12) United States Patent
Kessler et al.

(10) Patent No.: US 10,741,938 B2
(45) Date of Patent: Aug. 11, 2020

(54) TERMINAL BOARD FOR FASTENING ELECTRICAL LINES, AND METHOD FOR FASTENING ELECTRICAL LINES TO A TERMINAL BOARD

(71) Applicant: VALEO SIEMENS EAUTOMOTIVE GERMANY GMBH, Erlangen (DE)

(72) Inventors: Bernhard Kessler, Burkardroth (DE); Stephan Hellmuth, Bad Neustadt (DE); Monique Eiling, Bad Neustadt (DE); Sebastian Dieterich, Bad Neustadt (DE)

(73) Assignee: VALEO SIEMENS EAUTOMOTIVE GERMANY GMBH, Erlangen (DE)

( * ) Notice: Subject to any disclaimer, the term of this patent is extended or adjusted under 35 U.S.C. 154(b) by 0 days.

(21) Appl. No.: 15/978,998

(22) Filed: May 14, 2018

(65) Prior Publication Data

US 2018/0331439 A1 Nov. 15, 2018

(30) Foreign Application Priority Data

May 15, 2017 (DE) ..... 10 2017 110 527

(51) Int. Cl.

| | |
|---|---|
| ***H01R 4/66*** | (2006.01) |
| ***H01R 9/28*** | (2006.01) |
| ***H01R 4/18*** | (2006.01) |
| ***H01R 4/34*** | (2006.01) |
| ***H01R 43/048*** | (2006.01) |
| ***H01R 9/18*** | (2006.01) |
| ***H01R 11/12*** | (2006.01) |
| ***H01R 43/04*** | (2006.01) |
| ***H01R 43/20*** | (2006.01) |

(52) U.S. Cl.

CPC ..... *H01R 9/28* (2013.01); *H01R 4/18* (2013.01); *H01R 4/34* (2013.01); *H01R 9/18* (2013.01); *H01R 11/12* (2013.01); *H01R 43/04* (2013.01); *H01R 43/0484* (2013.01); *H01R 43/20* (2013.01)

(58) Field of Classification Search

CPC ..... H01R 13/65802; H01R 4/64; H01R 2201/26; H01R 13/5208

USPC ..... 439/95, 92, 34, 587

See application file for complete search history.

(56) References Cited

U.S. PATENT DOCUMENTS 8,597,062 B2 * 12/2013 Casses ..... H01R 4/184 439/686

2008/0003893 A1 * 1/2008 Frenken ..... H01R 4/30 439/813

FOREIGN PATENT DOCUMENTS

| | | |
|---|---|---|
| DE | 10 2005 007 203 A1 | 4/2006 |
| DE | 10 2008 039 786 B3 | 4/2010 |
| WO | 2004/010539 A1 | 1/2004 |
| WO | 2010/029391 A1 | 3/2010 |

* cited by examiner

*Primary Examiner* — Phuong Chi Thi Nguyen

(74) *Attorney, Agent, or Firm* — Manabu Kanesaka

(57) ABSTRACT

The invention relates to a terminal board for fastening electrical lines including at least one threaded hole so as to fasten a connecting element of an electrical line by way of a screw that can be screwed or is screwed into the threaded hole, wherein the terminal board includes a cylindrical insert having the threaded hole, and the connecting element and the insert are joined to one other by way of plastic deformation. The invention furthermore relates to a method for fastening electrical lines to a terminal board.

11 Claims, 4 Drawing Sheets

TERMINAL BOARD FOR FASTENING ELECTRICAL LINES, AND METHOD FOR FASTENING ELECTRICAL LINES TO A TERMINAL BOARD

RELATED APPLICATIONS

The present application is based on, and claims priority from, German Application No. DE 10 2017 110 527.1 filed May 15, 2017, the disclosure of which is hereby incorporated by reference herein in its entirety.

The invention relates to a terminal board for fastening electrical lines, comprising at least one threaded hole so as to fasten a connecting element of an electrical line by way of a screw that can be screwed or is screwed into the threaded hole.

Such terminal boards, which are also referred to as terminal blocks, are used in traction motors for electric vehicles or hybrid vehicles, for example. In these, it is necessary to connect three lines, which are connected to the motor and assigned to a respective phase, to the corresponding lines connected to an inverter. In such applications, only limited installation space is available. For cost reasons, it is desirable to replace conventional high voltage connectors by connecting the lines directly to the terminal board. When a traction motor is used in a vehicle, usually the need exists to fix the motor-side lines, or more precisely the cable lugs of the motor-side lines, first to the terminal board. The connection of the inverter-side lines or cable lugs takes place later. In the past, terminal boards in which the motor-side and the inverter-side cable lugs were screwed on separately were used. This allowed the motor-side cable lugs to be fixed in advance, before the inverter-side cable lugs were screwed onto the vehicle. Due to the limited installation space, however, this is not always possible.

It is therefore the object of the invention to provide a terminal board for fastening electrical lines, which are connected to the motor on one side and to the inverter on the other side, wherein the terminal board has low requirements with regard to the installation space.

To achieve this object, it is provided according to the invention that a terminal board of the type mentioned at the outset comprises an insert having a threaded hole, and that the connecting element and the threaded hole are joined to one another by way of plastic deformation.

The invention is based on the finding that space-saving and economical fastening of electrical lines to a terminal board can take place by joining a connecting element to the terminal board by way of a joining method, without screwing the connecting element to the terminal board. The connecting element of a first line is thus fixedly joined to the insert including the threaded hole by way of plastic deformation.

The first electrical line is preferably connected to the motor. Preferably, three such electrical lines are present, which are connected to the motor. Each line is assigned to a phase of the motor designed as a three-phase motor. The terminal board according to the invention has the advantage that no screw or the like must be screwed into the threaded hole so as to join the first electrical line to the threaded hole. The plastic deformation takes place so as not to impair the function of the threaded hole. This means that is possible to screw a screw, or another fastening means having an external thread, into the threaded hole even after the connecting element of the first electrical line has been joined to the threaded hole. The fastening of the second electrical line, which is preferably connected to the inverter, can take place at a later point in time, and in particular after the motor and the inverter have been installed in the vehicle body.

With respect to the terminal board according to the invention, it is preferred that the insert including the threaded hole has a cylindrical design. The insert can be made of a different material than the terminal board. Preferably, the terminal board is made of an electrically insulating material, such as a plastic material. The insert including the threaded hole can be made of a metallic material or a metal alloy, such as a steel alloy or a copper alloy.

Within the scope of the invention, it may be provided that the insert is inserted into a cut-out of the terminal board according to the invention and comprises an end section that projects from a surface area of the terminal board and is joined to the connecting element by way of plastic deformation. In addition to the section forming the threaded hole, the insert thus comprises the projecting end section, which is not present in conventional threaded holes or threaded inserts. This projecting end section can be plastically deformed after the connecting element, which is located at the end of the end of the line, has been positioned. As a result of the plastic deformation, the connecting element is joined to the end section in a form-locked manner. The plastic deformation is carried out in such a way that the threaded hole remains accessible and allows a screw or similar component to be screwed in, so as to fasten a second electrical line, and preferably a line connected to the inverter, in the same location.

Within the scope of the invention, it is preferred that the plastic deformation is created by way of a crimping method and/or by way of press-fit stemming and/or by way of flanging. Appropriate tools are used for all aforementioned methods, which are suitable for plastically deforming the end section and/or the connecting element of the electrical line. As a result of the plastic deformation, a form fit and/or a force fit is created between the end section of the threaded hole and the connecting element, whereby the two components are fixedly joined to one another.

Preferably, it may be provided on the terminal board according to the invention that an undercut is created between the connecting element and the threaded hole, and in particular the insert, as a result of the plastic deformation.

It is particularly advantageous when it is provided on the terminal board according to the invention that an electrically conducting connection is established between the connecting element and the threaded hole as a result of the plastic deformation. The electrically conducting connection thus established enables particularly good and low-loss electrical contact.

A preferred variant of the terminal board according to the invention provides for the connecting element to be designed as a cable lug and to include a cut-out that is adapted to the diameter of the threaded hole. Such a cable lug can be press fitted with a cable end of the electrical line. The cable lug can comprise a plate-shaped section including a cut-out. The cut-out preferably has a circular design. As an alternative, a cable lug can also have a semi-circular outer contour, for example.

It is also within the scope of the invention that the terminal board comprises a first electrical line, the connecting element of which is joined to the threaded hole by way of plastic deformation, and a second electrical line, which comprises a connecting element and is joined to the terminal board by way of a screw that is screwed into the threaded hole. The advantage of this arrangement is that the first electrical line is joined first to the terminal board and sub-assembled by way of plastic deformation. The first electrical is preferably the line connected to the motor. Thereafter, the second line, which is preferably connected to the inverter, can be fastened to the terminal board by way of the screw.

It is particularly preferred that the terminal board according to the invention includes multiple, and preferably three, threaded holes. Each threaded hole can be used to fasten the two lines, which are connected to the inverter on one side and to the motor on the other side, wherein each of the three threaded holes is assigned to a phase.

The invention furthermore relates to a method for fastening electrical lines to a terminal board. The method includes the following steps: generating a threaded hole in the terminal board by inserting an insert, which includes the threaded hole, into a cut-out of the terminal board; positioning a connecting element of an electrical line over the insert of the terminal board, and joining the connecting element and the insert by way of plastic deformation.

In the method according to the invention, it is preferred that a cylindrical insert is inserted into a cut-out of the terminal board.

Preferably, an insert, having an end that protrudes from the surface of the terminal board and is plastically deformed so as to be joined to the connecting element, is used in the method according to the invention.

According to one refinement of the method according to the invention, the plastic deformation takes place by way of a crimping method and/or press-fit stemming and/or flanging.

One variant of the method according to the invention provides for the use of a first electrical line, the connecting element of which is joined to the threaded hole by way of plastic deformation, and a second electrical line, which comprises a connecting element and is joined to the terminal board by way of a screw that is screwed into the threaded hole.

The invention will be described hereafter based on exemplary embodiments with reference to the figures. The drawings are schematic illustrations. In the drawings.

Figure 1:
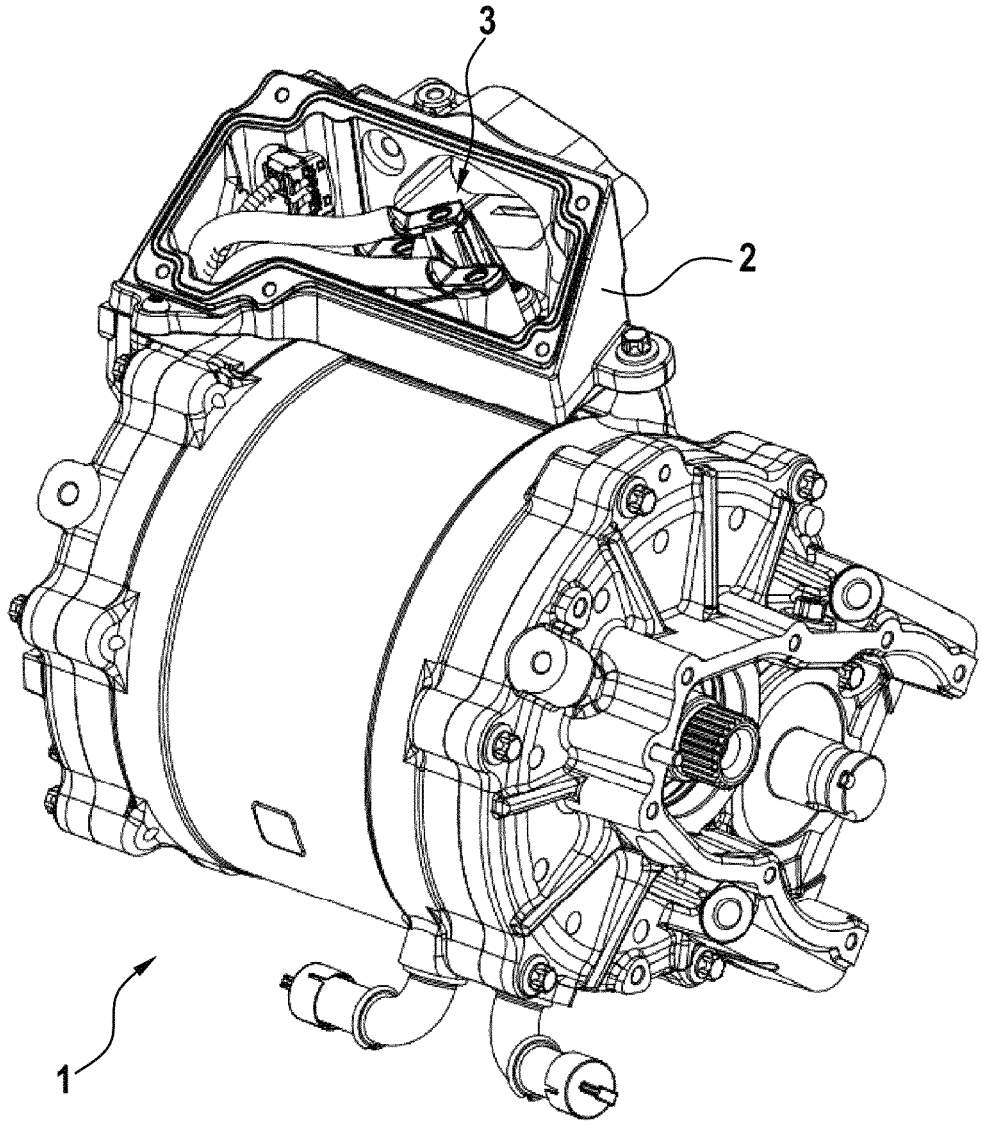
FIG. 1 shows a perspective view of a terminal board connected to an electric motor.

FIG. 1 shows a perspective view of an electric motor 1, which is designed as a traction motor of a vehicle. A housing 2, which surrounds a terminal board 3 for electrical lines, is fastened to the outside of the electric motor 1. It is apparent from FIG. 1 that a total of three electrical lines are fastened to the terminal board 3, which are connected to the electric motor 1. The terminal board 3 serves to subsequently connect lines, which are connected to the electric motor 1, to further lines (not shown), which are connected to the inverter. Thereafter, the housing 2, which is open in FIG. 1, is closed by a cover (not shown).

Figure 2:
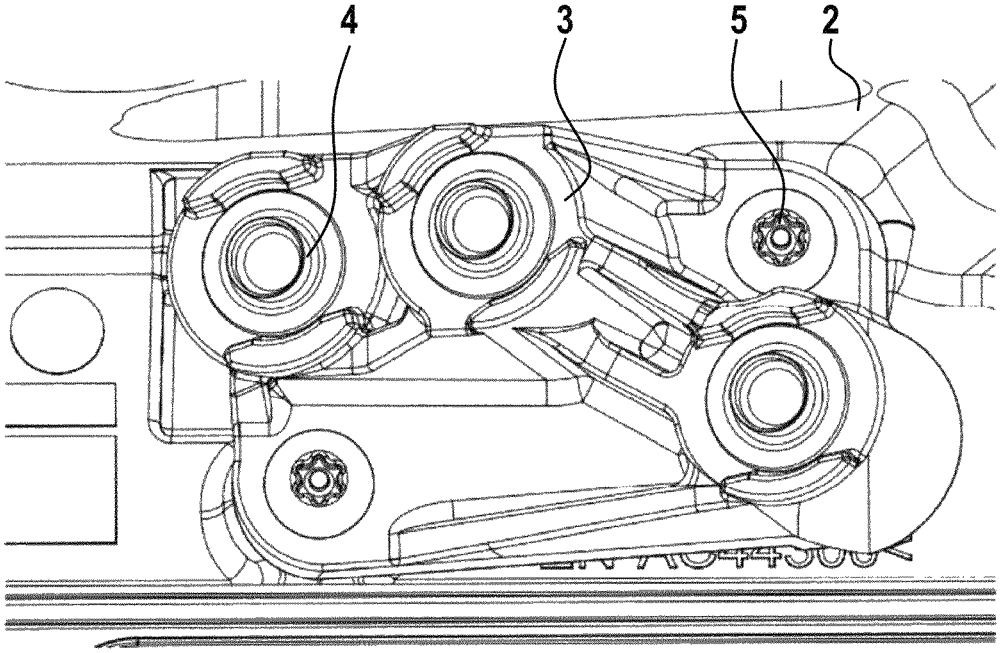
FIG. 2 shows a detail of the terminal board.

FIG. 2 is an enlarged view of a detail of the terminal board 3, which is present in the housing 2. The terminal board 3 comprises three inserts 4, which each include a threaded hole. The inserts 4 are designed as cylindrical threaded bushings. Each insert 4 is located in a cut-out of the terminal board 3. The terminal board 3 is joined to the housing 2 by way of screws 5.

Figure 3:
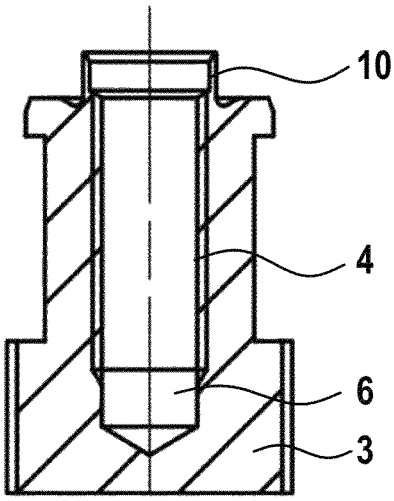
FIG. 3 shows a cut view of an insert including a threaded hole.

FIG. 3 shows a cut view of an insert 4, which is designed as a threaded bushing and inserted into a cut-out 6 of the terminal board 3. The insert 4 is pressed into the cut-out 6 and fixedly joined to the terminal board 3.

Figure 4:
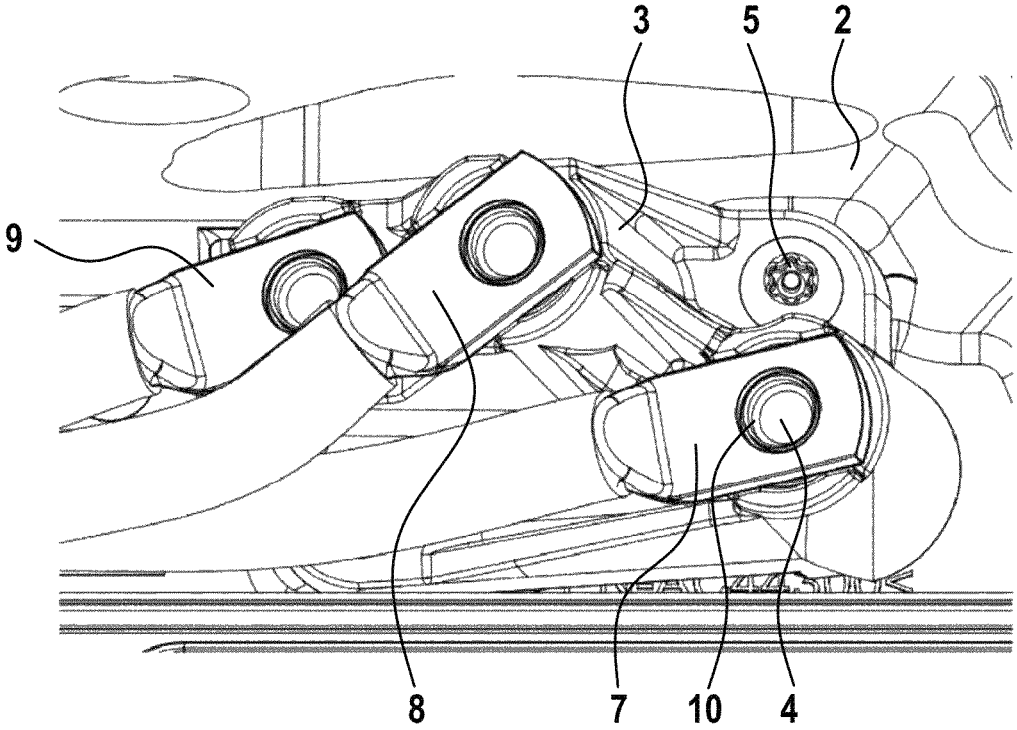
FIG. 4 shows the terminal board shown in FIG. 2 after the installation of the lines.

FIG. 4 shows a view similar to that of FIG. 2 and illustrates the terminal board 3 after cable lugs 7, 8, 9 of motor-side lines have been attached.

It is apparent from FIGS. 2 and 3 that an insert 4 comprises an end section 10, which projects from the cut-out 6 and is used to establish a form-locked joint between a cable lug and the insert 4 by way of plastic deformation. In the shown exemplary embodiment, the plastic deformation takes place by way of crimping. The insert 4 made of a metallic material is deformed in such a way that the projecting end section 10 thereof is pressed radially outward.

Figure 5:
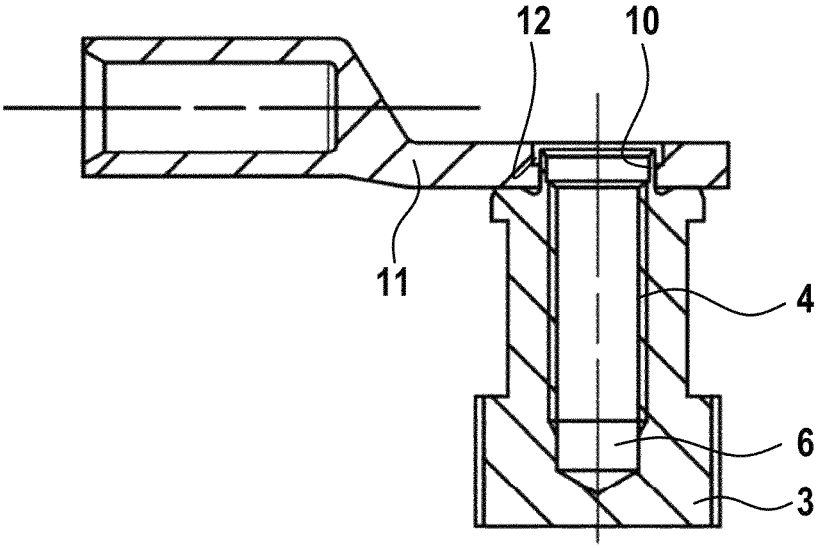
FIG. 5 shows a view similar to that of FIG. 3, comprising an attached cable lug.

FIG. 5 shows a view similar to that of FIG. 3 and illustrates the insert 4 comprising an attached cable lug 11 of a motor-side line. During the plastic deformation, the end section 10 is pressed radially outward, thereby being fixedly joined to the cable lug 11. The cable lug 11 comprises a step 12, which after the plastic deformation forms an undercut that prevents the cable lug 11 from detaching. The plastic deformation takes place by way of crimping in this exemplary embodiment. As a result of the crimping, both the described mechanical joint and an electrically conducting connection are established, by way of the cable lug 11, between the insert 4 and the motor-side line connected to the cable lug 11.

The terminal board 3 shown in FIGS. 4 and 5 forms a sub-assembled unit together with the motor-side lines 7, 8, 9 fastened thereto.

Figure 6:
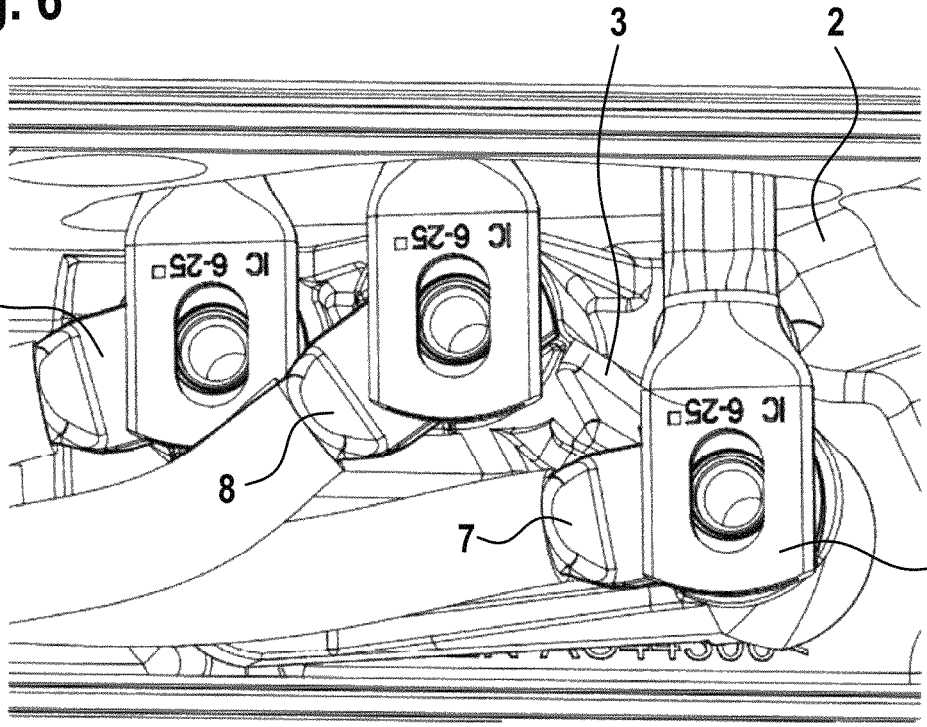
FIG. 6 shows the terminal board comprising inverter-side cable lugs.
Figure 7:
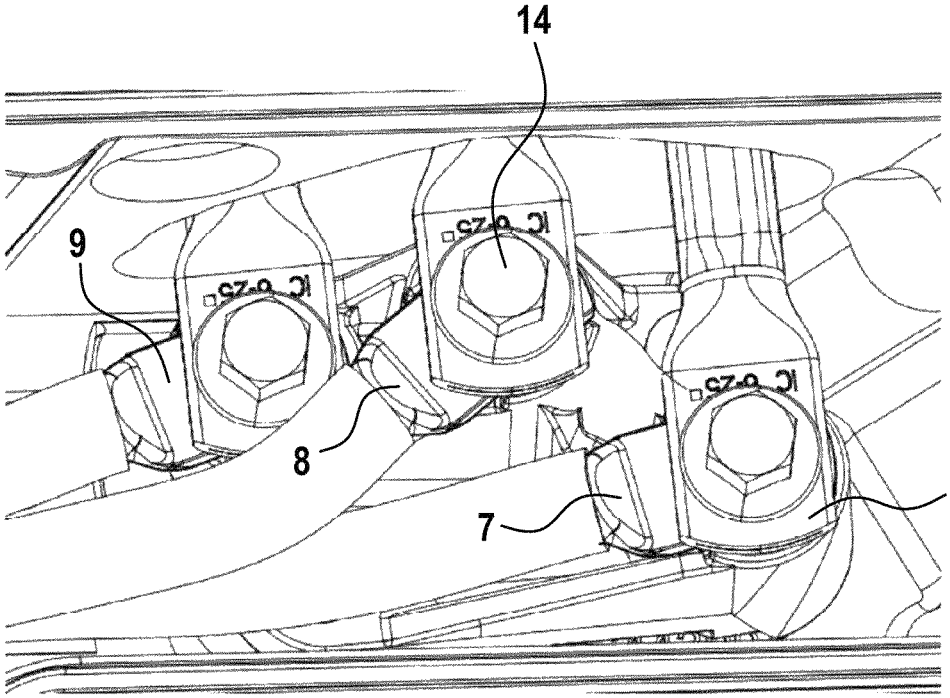
FIG. 7 shows the terminal board shown in FIG. 6 comprising attached electrical lines.

FIG. 6 shows the terminal board 3 after the installation of inverter-side cable lugs 13. For the installation of the inverter-side cable lugs 13, which are each connected to inverter-side lines (not shown), the inverter-side cable lugs 13 are positioned on the inserts 4 so that openings of the inverter-side cable lugs 13 are aligned with the inserts 4. Thereafter, as is shown in FIG. 7, screws 14 are screwed into the inserts 4, whereby the motor-side cable lugs 11 and the respective inverter-side cable lugs 13 are fixedly joined to the terminal board 3.

The described terminal board 3 has the advantage that the motor-side lines 7, 8, 9 can be sub-assembled with the inserts 4, designed as threaded bushings, by way of crimping. The subsequent installation of the inverter-side cable lugs 13 can take place particularly easily, without requiring the loosening of a screw joint or the like.

LIST OF REFERENCE NUMERALS

1 electric motor
2 housing
3 terminal board
4 insert
5 screw
6 cut-out
7, 8, 9 motor-side line
10 end section
11 motor-side cable lug
12 step
13 inverter-side cable lug
14 screw

The invention claimed is:

1. A terminal board assembly for fastening electrical lines, comprising:

a terminal board having a cut-out therein, a cylindrical insert inserted into the cut-out of the terminal board and including an end section that projects from a surface area of the terminal board, a first electrical line including a connecting element, and a second electrical line including another connecting element, wherein the cylindrical insert includes a threaded hole so as to fasten the another connecting element of the second electrical line to the terminal board by way of a screw that is screwed into the threaded hole, wherein the end section of the cylindrical insert is jointed to the connecting element of the first electrical line by way of plastic deformation, and wherein an electrically conducting connection is established between the connecting element of the first electrical line and the cylindrical insert as a result of plastic deformation.

2. The terminal board assembly according to claim 1, wherein the plastic deformation is created by at least one of a crimping method, press-fit stemming, and flanging.

3. The terminal board assembly according to claim 1, wherein an undercut is created between the connecting element of the first electrical line and the insert as a result of the plastic deformation.

4. The terminal board assembly according to claim 1, wherein the connecting element is designed as a cable lug and includes a cut-out that is adapted to a diameter of the threaded hole.

5. The terminal board assembly according to claim 1, further comprising a plurality of terminal boards, each having the cut-out, and a plurality of cylindrical inserts, each being inserted into the cut-out and having the threaded hole.

6. The terminal board assembly according to claim 1, wherein the connecting element includes an opening, the another connecting element includes another opening, and the opening, the another opening, and the threaded hole are arranged to be aligned each other, and the end section of the cylindrical insert is fit into the opening of the first electrical line through the plastic deformation, and the second electrical line is arranged on the first electrical line to fix the second electrical line to the terminal board through the screw.

7. The terminal board assembly according to claim 6, wherein the terminal board includes a flange portion having the surface area at a top surface thereof, and the end section projects outwardly from the top surface of the flange portion to be exposed, and when the screw is screwed in the threaded hole to fasten the second electrical line to the terminal board, the first electrical line and the second electrical line are pressed toward the flange portion.

8. A method for fastening electrical lines to a terminal board, comprising the following steps:

generating a threaded hole in the terminal board by inserting an insert, which includes the threaded hole, into a cut-out of the terminal board;

positioning a connecting element of a first electrical line over the insert of the terminal board;

joining the connecting element and the insert by way of plastic deformation; and joining another connecting element of a second electrical line to the terminal board by way of a screw that is screwed into the threaded hole.

9. The method according to claim 8, wherein the insert is used which comprises an end section that projects from a surface of the terminal board and is plastically deformed so as to be joined to the connecting element.

10. The method according to claim 8, wherein the plastic deformation takes place by at least one of crimping, press-fit stemming, and flanging.

11. A terminal board assembly for fastening electrical lines, comprising:

a terminal board portion having a cut-out therein, and a cylindrical insert inserted into the cut-out, and including a cylindrical portion arranged inside the terminal board portion, an end section formed at one end of the cylindrical portion and projecting outwardly from the terminal board portion, a threaded hole formed inside the cylindrical insert so that when a screw is adapted to be screwed with the threaded hole, the end section is pressed radially outwardly and adapted to fix one of the electrical lines to the terminal board.

* * * * *